US006535169B2

(12) United States Patent
Fourdeux et al.

(10) Patent No.: US 6,535,169 B2
(45) Date of Patent: Mar. 18, 2003

(54) SOURCE ANTENNAS FOR TRANSMITTING/ RECEIVING ELECTROMAGNETIC WAVES FOR SATELLITE TELECOMMUNICATIONS SYSTEMS

(75) Inventors: Henri Fourdeux, Corps-Nuds (FR); Ali Louzir, Rennes (FR); Philippe Minard, Rennes (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/874,696

(22) Filed: Jun. 5, 2001

(65) Prior Publication Data

US 2002/0018019 A1 Feb. 14, 2002

(30) Foreign Application Priority Data

Jun. 9, 2000 (FR) ..... 00 07423

(51) Int. Cl.[7] ..... H01Q 1/38; H01Q 21/00

(52) U.S. Cl. ..... 343/700 MS; 343/725; 343/772

(58) Field of Search ..... 343/700 MS, 725, 343/846, 772, 785, 786, 767, 773

(56) References Cited

U.S. PATENT DOCUMENTS 5,005,019 A 4/1991 Zaghloul et al. ..... 343/700
5,041,840 A 8/1991 Cipolla et al. ..... 343/725
5,510,803 A * 4/1996 Ishizaka et al. ..... 343/700 MS
5,661,494 A * 8/1997 Bondyopadhyay ... 343/700 MS
6,362,788 B1 * 3/2002 Louzir ..... 343/700 MS

FOREIGN PATENT DOCUMENTS

FR 2773271 A1 7/1999 ..... H01Q/13/00

OTHER PUBLICATIONS

Patent Abstracts of Japan, vol. 009, No. 131 of Jun. 6, 1985 and JP 60 018004 A of Jan. 30, 1985.
John Huang et al., "Tri–Band Frequency Selective Surface with Circular Ring Elements", IEEE Transactions on Antennas and Propagation, IEEE, Inc. New York, vol. 42, No. 2, pp. 166–175.
French Search Report (translation enclosed) citing the above–listed references: AA, AB, AM, AR and AS.

* cited by examiner

*Primary Examiner*—Hoang Nguyen
(74) *Attorney, Agent, or Firm*—Joseph S. Tripoli; Kuniyuki Akiyama

(57) ABSTRACT

The present invention relates to a source antenna for transmitting/receiving electromagnetic waves comprising means for transmitting electromagnetic waves with longitudinal radiation operating in a first frequency band and means for receiving electromagnetic waves, characterized in that the means for receiving electromagnetic waves consist of a first array of n radiating elements operating in a second frequency band and a second array of n' radiating elements operating in a third frequency band, the first and second arrays and the longitudinal-radiation means having a substantially common phase centre and the radiating elements of the first and second arrays being arranged around the longitudinal-radiation means.

17 Claims, 5 Drawing Sheets

SOURCE ANTENNAS FOR TRANSMITTING/RECEIVING ELECTROMAGNETIC WAVES FOR SATELLITE TELECOMMUNICATIONS SYSTEMS

FIELD OF THE INVENTION

The present invention relates to a source-antenna for transmitting/receiving electromagnetic waves, more particularly a system of source-antennas allowing the reception of satellite television signals in a certain frequency band such as the Ku band lying between 10.7 and 12.75 GHz and of satellite communications in a second frequency band such as the Ka band at around 30 GHz in transmission and at around 20 GHz in reception, using just a single structure of antennas.

BACKGROUND OF THE INVENTION

There are at present source-antenna structures for transmitting/receiving electromagnetic waves which operate with two frequency bands. These source-antennas make it possible to meet the requirements of satellite communication systems in respect of high bit rate multimedia applications. An antenna of this type has been proposed in patent WO 99/35111 in the name of THOMSON multimedia. These dual-band antenna structures are composed of two cofocused antennas. Thus, as described in the abovementioned patent application, the first antenna used for reception or downpath consists of an array of n patches. This array can be used in linear or circular polarization and benefit from two orthogonal polarizations. The second antenna used for transmission or uppath consists of a waveguide terminating in a dielectric rod commonly referred to as a "polyrod". This antenna can be used in linear or circular polarization and benefit from two orthogonal polarizations. These two antennas are made in such a way that the phase centres of the "polyrod" and of the array of patches practically coincide and can be placed at the focus of the system of antennas.

BRIEF DESCRIPTION OF THE INVENTION

The aim of the present invention is to incorporate into a transmission/reception source-antenna structure operating in two frequency bands another source-antenna structure which operates in respect of reception, namely the downpath, at a lower working frequency than the other two frequencies, more particularly in a frequency band allowing the reception of conventional satellite television signals. This makes it possible to obtain an antenna structure operating on three frequency bands.

Thus, the subject of the present invention is a source antenna for transmitting/receiving electromagnetic waves comprising means for transmitting electromagnetic waves with longitudinal radiation operating in a first frequency band and means for receiving electromagnetic waves, characterized in that the means for receiving electromagnetic waves consist of a first array of n radiating elements operating in a second frequency band and a second array of n' radiating elements operating in a third frequency band, the first and second arrays and the longitudinal-radiation means having a substantially common phase centre and the radiating elements of the first and second arrays being arranged around the longitudinal-radiation means.

According to one embodiment, the first array of n radiating elements consists of an array of n patches having linear or circular, orthogonal double polarization, the first array of n patches being connected to a feed circuit made in microstrip technology on a first substrate.

Moreover, the means for transmitting electromagnetic, waves with longitudinal radiation consist of an antenna of the longitudinal-radiation travelling wave type with axis coinciding with the axis of radiation, excited by means comprising a waveguide, the waveguide being filled with a dielectric material. This makes it possible to restrict the dimensions of the cross section of the waveguide and to reduce the guided wavelength inside the guide. Moreover, the antenna of the travelling wave type may consist of a dielectric rod known as a "polyrod" or of a helix.

Furthermore, the second array of n' radiating elements consists of an array of n' radiating elements having linear or circular, orthogonal double polarization and a wide band. This array is made, preferably, by using two parallel substrates, one of the substrates being the first substrate receiving the first array.

According to a first embodiment, the substrate is covered with a metallic layer forming an earth plane comprising demetallized zones, at the level of the radiating elements of the second array.

According to a preferred embodiment, the radiating elements of the array with orthogonal double polarization and a wide band consist of two patches which are superimposed and made respectively on each substrate and coupled electromagnetically. In this case, the two substrates may be connected plumb with the demetallized zones by metallic walls.

According to another embodiment, the radiating elements of the array with orthogonal double polarization and with a wide band consist of a patch coupled electromagnetically to. a probe connected to the feed circuit.

According to yet another embodiment, the radiating elements of the array with orthogonal double polarization and a wide band consist of an aperture made in the first substrate and a probe connected to the feed circuit and made on the parallel substrate.

According to yet another embodiment, the radiating elements of the array with orthogonal double polarization and a wide band consist of an aperture made in the first substrate and a patch connected to the feed circuit and made on the parallel substrate.

Moreover, the second array of n' radiating elements is connected to a feed circuit made in microstrip technology.

According to a characteristic of the present invention, the first array of n radiating elements is an array with four elements arranged in a square and the second array of n' radiating elements is an array with four elements arranged in a cross around the first array.

In accordance with the present invention, the first and second frequency bands correspond to the Ka band and the third frequency band corresponds to the Ku band.

BRIEF DESCRIPTION OF THE DRAWINGS

Other characteristics and advantages of the present invention will become apparent on reading the following description, this description being given with reference to the herein-appended drawings in which.

To simplify the description, the same references will be used in the various figures to designate the elements fulfilling the same functions or identical functions.

DESCRIPTION OF PREFERRED EMBODIMENTS

Figure 1:
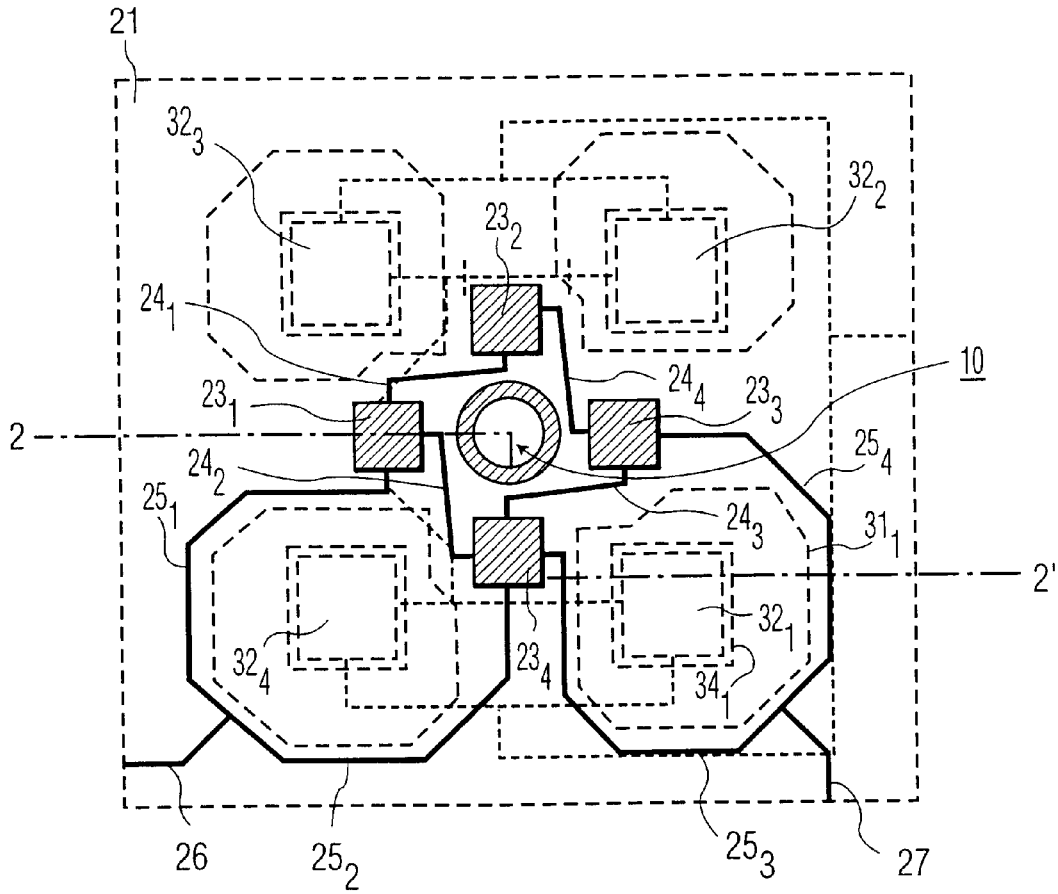
FIG. 1 is a plan, view from above of a source-antenna system operating in three frequency bands, in accordance with the present invention.
Figure 2:
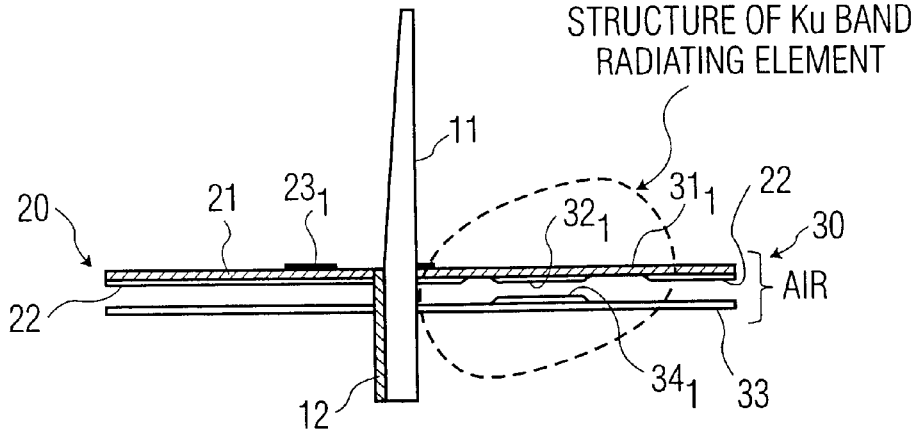
FIG. 2 is a sectional view through 2–2' of FIG. 1.
Figure 3:
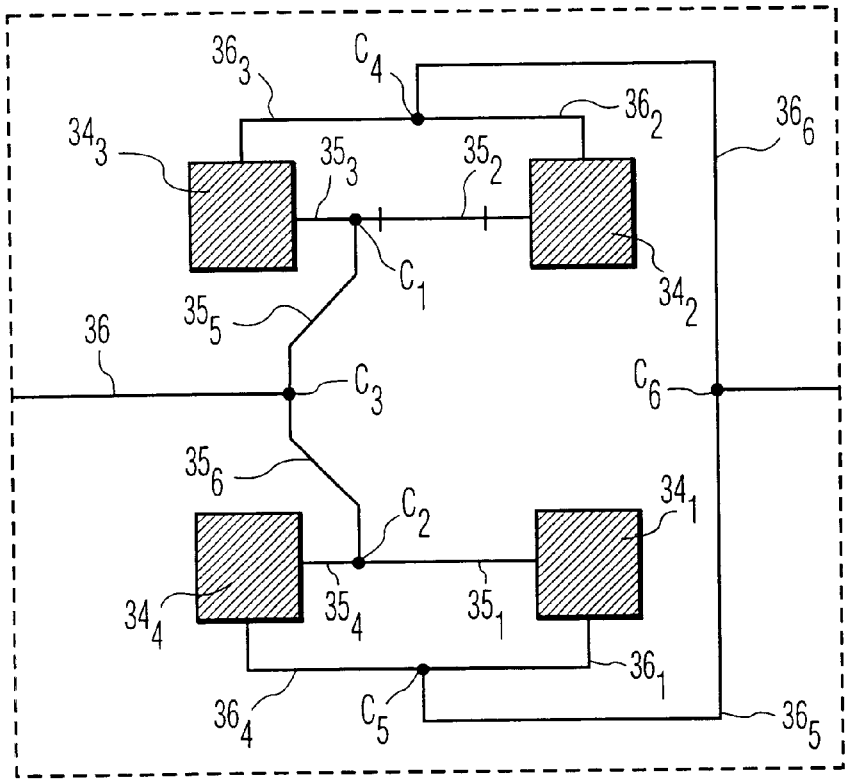
FIG. 3 is a view from above of the lower substrate of the source-antenna system of FIGS. 1 and 2.
Figure 4:
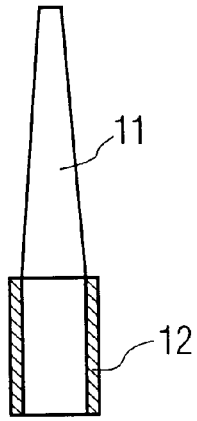
FIG. 4 is a sectional view of the "polyrod" used for transmission in Ka band in the system of FIGS. 1 and 2.

We shall now describe with reference to FIGS. 1 to 4 a first embodiment of a source-antenna for transmitting/receiving electromagnetic waves operating in three frequency bands. More specifically and as represented in FIGS. 2 and 4, the source-antennas system comprises a first source-antenna used for transmission or uppath, which, in the embodiment represented, operates in the Ka band, namely around 30 GHz.

As represented more particularly in FIGS. 2 and 4, the source-antenna structure used in this case consists essentially of a waveguide 12 terminating in a dielectric rod 11, this antenna structure being known by the term "polyrod". The cross section of the waveguide 12 can be circular, rectangular, square or other. The shape of the cross section depends on the amount of room left free by the other two source-antenna structures, as will be explained hereinbelow.

In the embodiment represented, the cross section of the waveguide is a circular section 12. As represented also in FIG. 4, this cross section is filled with dielectric material whose purpose is to reduce the guided wavelength inside the guide. It is obvious to the person skilled in the art that other types of travelling-wave source-antennas may be used to embody the antenna structure of t he uppath. Mention may be made, in particular, of helical antennas.

A first embodiment of the two source-antenna structures used on reception, namely for the downpath, will now be described with reference to FIGS. 1 to 3. As represented more. particularly in FIGS. 1 and 2, the source-antenna structure used for the downpath in the Ka band, namely around 20 GHz, consists of an array 20 of patches in linear polarization with two orthogonal polarizations and fed in series/parallel. More particularly, four patches $\mathbf{23}_1$, $\mathbf{23}_2$, $\mathbf{23}_3$, $\mathbf{23}_4$ of square shape arranged in a cross have been made on a substrate 21. The patches are arranged around the "polyrod" in such a way that their diagonal is at a distance D equal to 0.7 λg where λg is the guided wavelength.

In the embodiment represented, the patches are connected as represented in FIG. 1, namely the patch $\mathbf{23}_1$ is connected to the patch $\mathbf{23}_2$ by a line $\mathbf{24}_1$, the patch $\mathbf{23}_2$ is connected to the patch $\mathbf{23}_3$ by a line $\mathbf{24}_4$, the patch $\mathbf{23}_3$ is connected to the patch $\mathbf{23}_4$ by a line $\mathbf{24}_3$ and the patch $\mathbf{23}_4$ is connected to the patch $\mathbf{23}_1$ by a line $\mathbf{24}_2$. Moreover, the feed lines 26, 27 are connected in a specific manner on another input of the patches $\mathbf{23}_1$, $\mathbf{23}_4$, $\mathbf{23}_3$. The feed line 26 is connected by a line $\mathbf{25}_1$ to the patch $\mathbf{23}_1$ and by a line $\mathbf{25}_2$ to the patch $\mathbf{23}_4$ and the feed line 27 is connected to the patch $\mathbf{23}_4$ by a line $\mathbf{25}_3$ and to the patch $\mathbf{23}_3$ by a line $\mathbf{25}_4$ in such a manner as to produce a series/parallel feed. In this case, the lines $\mathbf{24}_1$, $\mathbf{24}_2$, $\mathbf{24}_3$ and $\mathbf{24}_4$ are of the same length. Given the gap between two patches, these lines have lengths like λg/2 modulo the guided wavelength.

One embodiment of the transmission/reception source-antenna structure for the downpath used in the Ku band, namely between 10.7 GHz and 12.75 GHz, will now be described with reference to FIGS. 2 and 3. In this case, the antenna comprises an array of four patches. This array of patches is arranged in a square around the array of four patches in a cross used for the electromagnetic wave source-antenna in the Ka band, owing to its lower working frequency.

As represented in FIG. 2, the Ku band source-antenna structure is made by using two parallel substrates 21, 33 on which, electromagnetically coupled parallel patches $\mathbf{32}_1$, $\mathbf{34}_1$ have been made, the lower substrate 33 being used to make the feed circuit which will be described subsequently and which can receive patches as represented in FIGS. 2 and 3, these electromagnetically coupled patches increasing the pass band. As represented in FIGS. 1 to 3, each patch $\mathbf{32}_1$, $\mathbf{32}_2$, $\mathbf{32}_3$, $\mathbf{32}_4$ is positioned on the first substrate 21 in a demetallized part $\mathbf{31}_1$, $\mathbf{31}_2$, $\mathbf{31}_3$, $\mathbf{31}_4$ of the layer 22 and the second substrate 33 on which a parallel patch $\mathbf{34}_1$ to $\mathbf{34}_4$ has been made receives the feed array. The feed array is represented in greater detail in FIG. 3. In this case, each patch is fed at two points in such a way as to obtain he two orthogonal polarizations. More specifically, the patch $\mathbf{34}_1$ is connected to the point C2 of the first feed circuit by a line $\mathbf{35}_1$, the patch $\mathbf{34}_4$ is connected to the point C2 by a line $\mathbf{35}_4$, the patch $\mathbf{34}_3$ is connected to the point C1 by a line $\mathbf{35}_3$ and the patch $\mathbf{34}_2$ is connected to the point C1 by a line $\mathbf{35}_2$. The points C1 and C2 are connected to the point C3 respectively by a line $\mathbf{35}_5$ and $\mathbf{35}_6$, the point C3 being connected to a feed line. The length of the lines $\mathbf{35}_3$ and $\mathbf{35}_4$ is equal, likewise the length of the lines $\mathbf{35}_2$ and $\mathbf{35}_1$ is equal and such that length $\mathbf{35}_2$–length $\mathbf{35}_3$=λg/2. Moreover, the patch $\mathbf{34}_3$ is connected by a second input to the point C4 by a line $\mathbf{36}_3$, the patch $\mathbf{34}_2$ is connected to the point C4 by a line $\mathbf{36}_2$, the patch $\mathbf{34}_1$ is connected to the point C5 by a line $\mathbf{36}_1$, the patch $\mathbf{34}_4$ is connected to the point C5 by a line $\mathbf{36}_4$, the point C4 being connected to the point C6 by a line $\mathbf{36}_6$ and the point C5 being connected to the point C6 by a line $\mathbf{36}_5$. The point C6 is connected to another feed in such a way as to obtain a parallel feed. In the second case, the lines $\mathbf{36}_1$, $\mathbf{36}_2$, $\mathbf{36}_3$, $\mathbf{36}_4$ are of the same length and the difference ΔL between the length of the line $\mathbf{36}_5$ and the length of the line $\mathbf{36}_6$=λg/2.

The various feed lines are connected in a known manner to reception circuits comprising at least a low-noise amplifier and a frequency converter. The circuits being well known to the person skilled in the art, they will not be described in greater detail. Thus, with the circuit described hereinabove, the patches $\mathbf{34}_1$, $\mathbf{34}_2$, $\mathbf{34}_3$, $\mathbf{34}_4$ are all fed in phase and with the same amplitude by two power dividers made in microstrip technology, the feeding of the patches having to be done in phase so that the electric fields add together in the direction of propagation of the guided waves. Specifically, the phase shift d between two horizontally polarized waves is equal to $d=\beta^* \Delta L$ where $\beta=(2\Pi/\lambda_g)$, $\lambda_g$ being equal to the wavelength of the guided wave.

In the embodiment represented, the patches are excited via opposite lateral sides. Thus, the patch $\mathbf{34}_1$ is excited via its left lateral side, this creating, at an instant t, a field E oriented from left to right while simultaneously the patch $\mathbf{34}_4$ is excited via its right lateral side which creates at the same instant t a field E oriented from right to left ultimately giving, out-of-phase fields. By introducing a wavelength difference given by the difference of the length of the lines $\mathbf{35}_1$ and $\mathbf{35}_4$ which is equal to $\lambda_g/2$, a further phase shift d is created such that $d=\beta^* \Delta L=(2\Pi/\lambda_g)^*x\ (\lambda_g/2)=\Pi$, thereby cancelling out the difference of the phases between the said electric fields. This configuration improves the quality of the polarization, since it eliminates the problems of cross polarization.

Various embodiments of the patches used in the framework of the Ku band reception source-antenna structure will now be described with reference to FIGS. 5*a*–5*b* to 9*a*–9*b*. Various figures represent the lower right part of the system of FIG. 1.

Figure 5A:
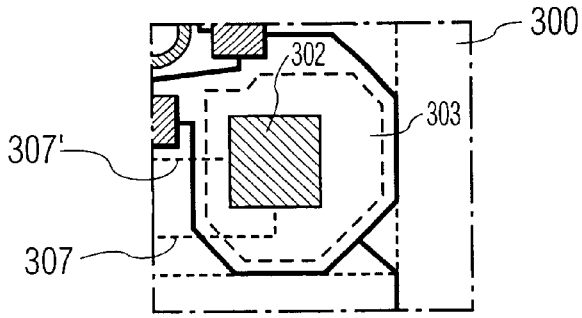
FIGS. 5*a*–5*b* to 9*a*–9*b* respectively represent a view from above and a sectional view of various embodiments of radiating elements or "patches" used for receiving in Ku band and in accordance with the present invention.
Figure 5B:
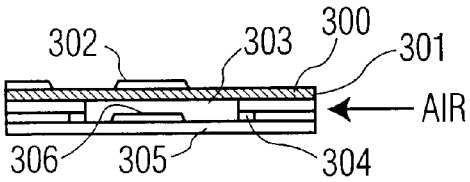

Represented in FIGS. 5*a*–5*b* is another embodiment of the patches. In this case, a patch 302 with square shape has been deposited on the upper substrate 300. As represented clearly in the figure, the earth plane 301 has been recessed in such a way as to form a window 303 facilitating radiation. Moreover, a second patch 306 electromagnetically coupled to the first patch 302 is made parallel to the first patch 302 on the lower substrate 304. The patch 306 is fed by the lines 307 and 307' in two orthogonal sides. In accordance with this embodiment, metal walls 304 are provided plumb with the window 303 in such a way as to favour forward radiation of the superimposed patches 306 and 302. The part between the two substrates 305-300 is filled with air. According to a variant, it could be filled with a material such as a foam.

Figure 6A:
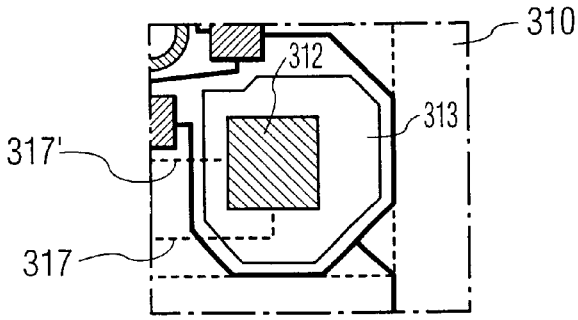
Figure 6B:
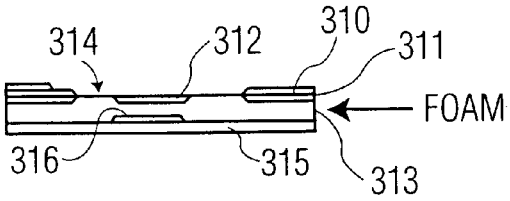

Represented in FIGS. 6*a* and 6*b* is another embodiment with superimposed patches. In this case, the upper substrate 310 furnished with the earth plane 311 is recessed to form a window 314. The part lying between the upper substrate 310 and the lower substrate 315 is filled with foam. The patch 312 is made on the foam and is coupled electromagnetically to the patch 316 made on the lower substrate 315. The patch 316 is fed like the patch 306 of FIGS. 5*a* and 5*b* by the lines 317 and 317'.

Figure 7A:
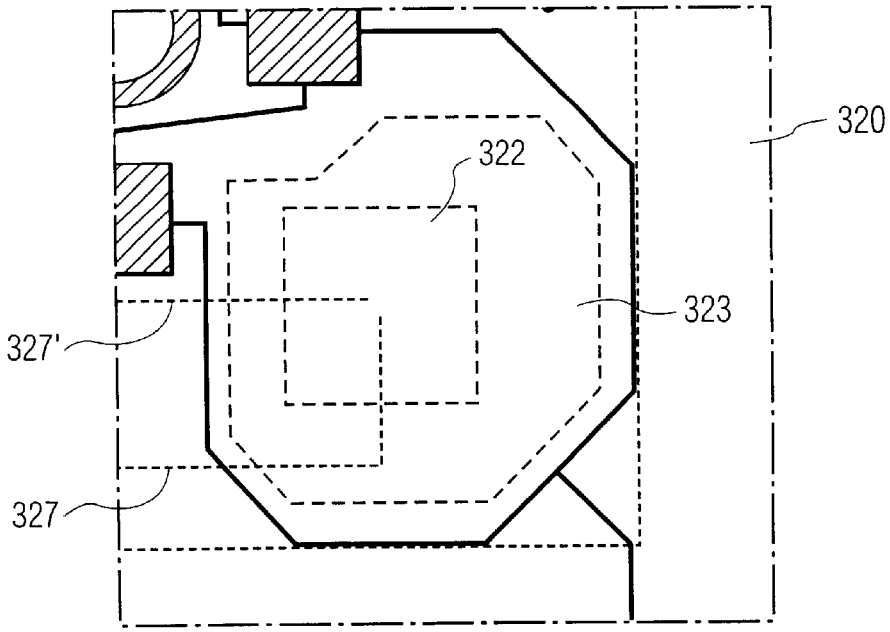
Figure 7B:
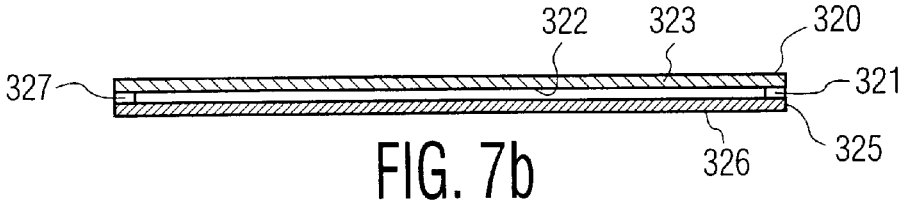

Yet another embodiment has been represented in FIGS. 7*a* and 7*b*. In this case, a patch 322 has been made on the upper substrate 320 in the window 323 obtained by demetallizing the earth plane 321. The feed circuit formed at least of the lines 327 and 327' is made on the lower substrate 325 furnished with an earth plane 326. In this case, the patch 322 is coupled electromagnetically with the lines 327, 327'.

Figure 8A:
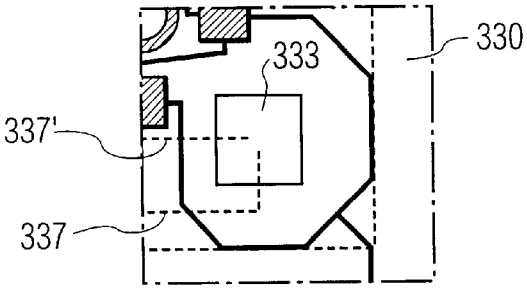
Figure 8B:
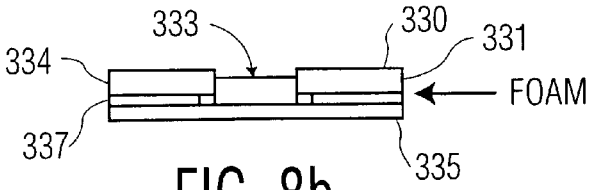

The embodiments of FIGS. 8*a* and 8*b* and FIGS. 9*a* and 9*b* are akin to a radiating aperture. Thus, as represented in FIGS. 8*a* and 8*b*, the upper substrate 330 furnished with its earth plane 331 is recessed to form a window 333. In the embodiment represented, the upper substrate 330 is mounted on the lower substrate 335 with interposition of the metal walls 334. The feed lines 337, 337' are made on the lower substrate 335. In this case, the radiating aperture thus made is excited by probes.

Figure 9A:
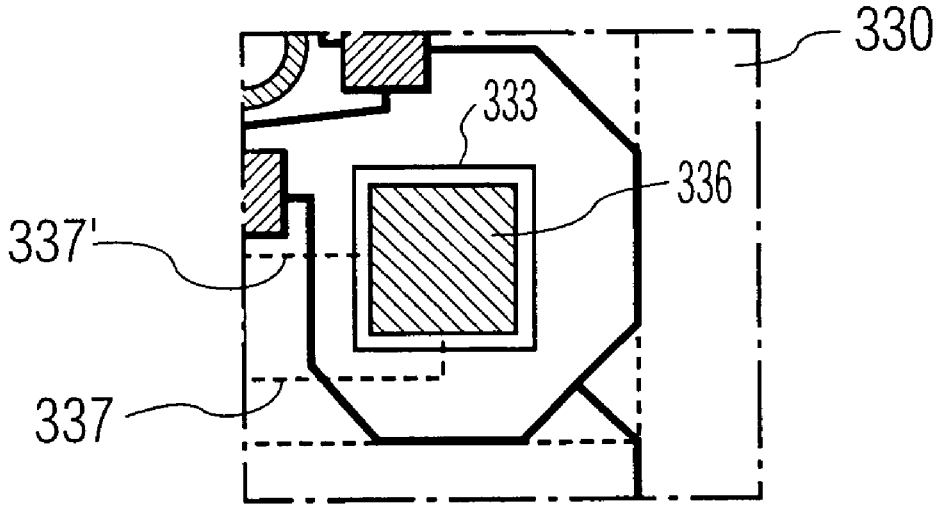
Figure 9B:
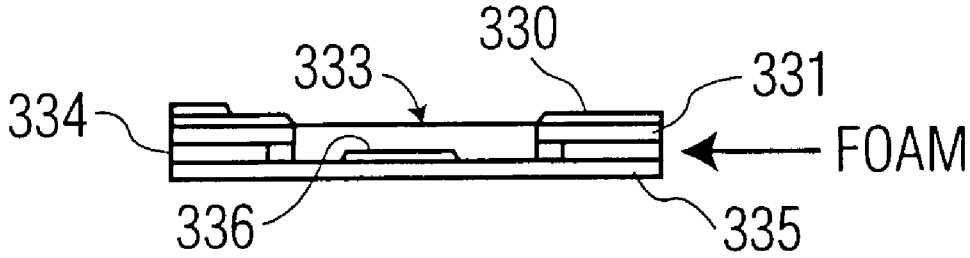

In the variant represented in FIGS. 9*a* and 9*b*, a patch 336 is made on the lower substrate 335. This patch 336 is connected to the feed lines 337, 337' in a conventional manner.

The embodiments described hereinabove by way of example make it possible to incorporate a source-antenna in reception operating in the Ka band with a source-antenna in reception operating in the Ku band, the two antennas being cofocused.

It is obvious to the person skilled in the art that the frequency bands are given by way of illustration and that the invention can also operate in other bands.

It is obvious to the person skilled in the art that other types of arrays could be used to produce the source-antennas structures used on reception, in particular any type of array comprising radiating elements with linear or circular, orthogonal double polarization.

What is claimed is:

1. Source antenna for transmitting/receiving electromagnetic waves comprising means for transmitting electromagnetic waves with longitudinal radiation operating in a first frequency band and means for receiving electromagnetic waves, wherein the means for receiving electromagnetic waves comprises a first array of n radiating elements operating in a second frequency band and a second array of n' radiating elements operating in a third frequency band, the first and second arrays and the longitudinal-radiation means having a substantially common phase centre and the radiating elements of the first and second arrays being arranged around the longitudinal-radiation means.

2. Source antenna according to claim 1, wherein the first array of n radiating elements comprises an array of n patches having linear or circular, orthogonal double polarization.

3. Source antenna according to claim 2, wherein the first array of n patches is connected to a feed circuit made in microstrip technology on a first substrate.

4. Source antenna according to claim 1, wherein the means for transmitting electromagnetic waves with longitudinal radiation comprising an antenna of the longitudinal-radiation traveling wave type with axis coinciding with the axis of radiation, excited by means comprising a waveguide.

5. Source antenna according to claim 4, wherein the antenna of the longitudinal-radiation traveling wave type comprises a dielectric rod known as a "polyrod" or of a helix.

6. Source antenna according to claim 4, wherein the waveguide is filled with a dielectric material.

7. Source antenna according to claim 1, wherein the second array of n' radiating elements comprises an array of n' radiating elements having linear or circular, orthogonal double polarization and a wide band.

8. Source antenna according to claim 7, wherein the array of n' elements having linear or circular, orthogonal double polarization with a wide band is made by using two parallel substrates, one of the substrates being the first substrate receiving the first array.

9. Source antenna according to claim 7, wherein the radiating elements of the array with linear or circular, orthogonal double polarization and a wide band comprises two patches which are superimposed and made respectively on each substrate and coupled electromagnetically.

10. Source antenna according to claim 9, wherein the two substrates are connected plumb with the demetallized zones by metallic walls.

11. Source antenna according to claim 7, wherein the radiating elements of the array with linear or circular, orthogonal double polarization and with a wide band comprises a patch coupled electromagnetically to a probe connected to the feed circuit.

12. Source antenna according to claim 7, wherein the radiating elements of the array with linear or circular, orthogonal double polarization and a wide band comprises an aperture made in the first substrate and a probe connected to the feed circuit and made on the parallel substrate.

13. Source antenna according to claim 7, wherein the radiating elements of the array with linear or circular, orthogonal double polarization and a wide band comprises an aperture made in the first substrate and a patch connected to the feed circuit and made on the parallel substrate.

14. Source antenna according to claim 7, wherein the second array of n' radiating elements is connected to a feed circuit made in microstrip technology.

15. Source antenna according to claim 1, wherein the first and second frequency bands correspond to the Ka band and the third frequency band corresponds to the Ku band.

16. Source antenna for transmitting/receiving electromagnetic waves comprising means for transmitting electromagnetic waves with, longitudinal radiation operating in a first frequency band and means for receiving electromagnetic waves, wherein the means for receiving electromagnetic waves comprises a first array of n radiating elements operating in a second frequency band and a second array of n' radiating elements operating in a third frequency band, the first and second arrays and the longitudinal-radiation means having a substantially common phase centre and the radiating elements of the first and second arrays being arranged around the longitudinal-radiation means; wherein the second array of n' radiating elements comprises an array of n' radiating elements having linear or circular, orthogonal double polarization and a wide band; wherein the array of n' elements having linear or circular, orthogonal double polarization with a wide band is made by using two parallel substrates, one of the substrates being the first substrate receiving the first array; and wherein the first substrate is covered with a metallic layer forming an earth plane comprising demetallized zones, at the level of the radiating elements of the second array.

17. Source antenna for transmitting/receiving electromagnetic waves comprising means for transmitting electromagnetic waves with longitudinal radiation operating in a first frequency band and means for receiving electromagnetic waves, wherein the means for receiving electromagnetic waves comprises a first array of n radiating elements operating in a second frequency band and a second array of n' radiating elements operating in a third frequency band, the first and second arrays and the longitudinal-radiation means having a substantially common phase centre and the radiating elements of the first and second arrays being arranged around the longitudinal-radiation means; wherein the first array of n radiating elements is an array with four elements arranged in a square and in that the second array of n' radiating elements is an array with four elements arranged in a cross around the first array.

* * * * *